US007268493B2

(12) United States Patent
Kwon et al.

(10) Patent No.: US 7,268,493 B2
(45) Date of Patent: Sep. 11, 2007

(54) PLASMA DISPLAY PANEL WITH DUAL MATERIAL SUSTAIN ELECTRODES

(75) Inventors: Jae-Ik Kwon, Suwon-si (KR); Kyoung-Doo Kang, Suwon-si (KR); Seung-Uk Kwon, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 43 days.

(21) Appl. No.: 11/156,681

(22) Filed: Jun. 20, 2005

(65) Prior Publication Data

US 2005/0285531 A1 Dec. 29, 2005

(30) Foreign Application Priority Data

Jun. 26, 2004 (KR) ..... 10-2004-0048654

(51) Int. Cl.
*H01J 17/49* (2006.01)

(52) U.S. Cl. ..... 313/583; 313/582; 313/586; 313/584; 313/585

(58) Field of Classification Search ..... 313/582–587; 315/169.4; 345/60; 445/24
See application file for complete search history.

(56) References Cited

U.S. PATENT DOCUMENTS 6,437,514 B1 * 8/2002 Kurata et al. ..... 315/169.4
6,456,006 B1 * 9/2002 Torisaki ..... 313/582
6,479,932 B1 * 11/2002 Nunomura ..... 313/582
6,566,812 B1 * 5/2003 Torisaki et al. ..... 313/586
6,747,409 B1 * 6/2004 Han et al. ..... 313/583
6,879,104 B2 * 4/2005 Tessier ..... 313/582
2004/0080269 A1 * 4/2004 Tessier ..... 313/582
2005/0179384 A1 * 8/2005 Kwon et al. ..... 313/583
2005/0264234 A1 * 12/2005 Kwon et al. ..... 315/169.4
2006/0001675 A1 * 1/2006 Kwon et al. ..... 345/583

FOREIGN PATENT DOCUMENTS

KR 2005049865 A * 5/2005

OTHER PUBLICATIONS

English translation of Ahn et al.*

* cited by examiner

*Primary Examiner*—Karabi Guharay
*Assistant Examiner*—Peter Macchiarolo
(74) *Attorney, Agent, or Firm*—Knobbe, Martens, Olson & Bear LLP

(57) ABSTRACT

A plasma display panel having an electrode structure that can reduce the damaging of a fluorescent layer that generates green light by ion sputtering is disclosed. The plasma display panel includes: a rear substrate; a front substrate disposed apart from the rear substrate; a plurality of barrier ribs that define discharge cells of blue, green and blue light together with the rear substrate and the front substrate and disposed between the rear substrate and the front substrate; a plurality of sustain electrode pairs extended across the discharge cells; a plurality of address electrodes extended across the discharge cells to cross the sustain electrode pairs; a first dielectric layer that covers the sustain electrode pairs; a second dielectric layer that covers the address electrodes; a plurality of fluorescent layers of red, green, and blue light disposed in each of the discharge cells of red, green and blue light; and a discharge gas filled in the discharge cells, wherein each of the sustain electrodes comprises a bus electrode extended across the discharge cells, main body unit disposed apart from the bus electrode toward the inside of the discharge cell, and a connection unit that connects the bus electrode and the main body unit, the connection unit is disposed apart from the barrier ribs that define the green discharge cells.

18 Claims, 3 Drawing Sheets

PLASMA DISPLAY PANEL WITH DUAL MATERIAL SUSTAIN ELECTRODES

CROSS-REFERENCE TO RELATED PATENT APPLICATION

This application claims the benefit of Korean Patent Application No. 10-2004-0048654, filed on Jun. 26, 2004, in the Korean Intellectual Property Office, the disclosure of which is incorporated herein in its entirety by reference.

BACKGROUND OF THE INVENTION

1. Field of the Invention

The present invention relates to display technology, and more particularly, to a plasma display panel.

2. Description of the Related Technology

Recently, plasma display panels (PDP) have drawn great attention as devices for replacing conventional cathode ray tubes (CRT). PDPs create a visible image by exciting a fluorescent material formed in a discharge cell by generating a plasma discharge resulting in ultraviolet radiation being emitted in the discharge cell.

The lifetime of the PDPs can be reduced for various reasons. For example, the fluorescent material formed in the discharge cellmay be degraded as the fluorescent material experiences phase changes by vacuum ultra violet rays (VUV). Also, the fluorescent material or an MgO layer formed in the discharge cell may be damaged by ion sputtering occurring in the discharge cell.

FIG. 1 is a plan view of discharge cells of red 80R, green 80G, and blue 80B and sustain electrodes 31. As depicted in FIG. 1, the sustain electrode 31 is disposed over barrier ribs 30 that define the discharge cells 80R, 80G, 80B. In this configuration, during the discharge, space charges move to the barrier rib portion and sputter fluorescent material formed adjacent to the barrier ribs. The sputtering intensity of the space charges increases as the charges collide with the fluorescent material with high energy caused by a large potential energy difference in a plasma sheath region P adjacent to the barrier ribs.

SUMMARY OF CERTAIN INVENTIVE ASPECTS

The present invention provides a plasma display panel having a structure that can reduce the damaging of the fluorescent material that generates green light by ion sputtering.

According to an aspect of the present invention, there is provided a PDP comprising: a rear substrate; a front substrate disposed apart from the rear substrate; a plurality of barrier ribs that define discharge cells of red, green and blue light together with the rear substrate and the front substrate and disposed between the rear substrate and the front substrate; a plurality of sustain electrode pairs extended across the discharge cells; a plurality of address electrodes extended across the discharge cells to cross the sustain electrode pairs; a first dielectric layer that covers the sustain electrode pairs; a second dielectric layer that covers the address electrodes; a plurality of fluorescent layers of red, green, and blue light disposed in each of the discharge cells of red, green and blue light; and a discharge gas filled in the discharge cells, wherein each of the sustain electrodes comprises a bus electrode extended across the discharge cells, main body unit disposed apart from the bus electrode toward the center of the discharge cell, and a connection unit that connects the bus electrode and the main body unit, the connection unit is disposed apart from the barrier ribs that define the green discharge cells.

In the PDP according to the present invention, the connection unit can be disposed in front of the barrier ribs formed between the adjacent blue light discharge cell and the red light discharge cell. At this time, the connection unit is disposed in shadow regions of the barrier ribs formed between the adjacent blue light discharge cell and the red light discharge cell in a vertical direction to the front substrate.

Also, In the PDP according to the present invention, the damaging of the fluorescent material that generates green light by ion sputtering can be reduced since the ion sputtering caused at portions of the barrier ribs that define green light discharge cells of the PDP is reduced. Accordingly, a fluorescent material that contains ZnO can be used stably. The aperture ratio is improved since the connection unit is disposed in front of the barrier ribs, thereby increasing brightness.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF CERTAIN INVENTIVE EMBODIMENTS

The present invention will now be described more fully with reference to the accompanying drawings in which exemplary embodiments of the invention are shown.

Figure 1:
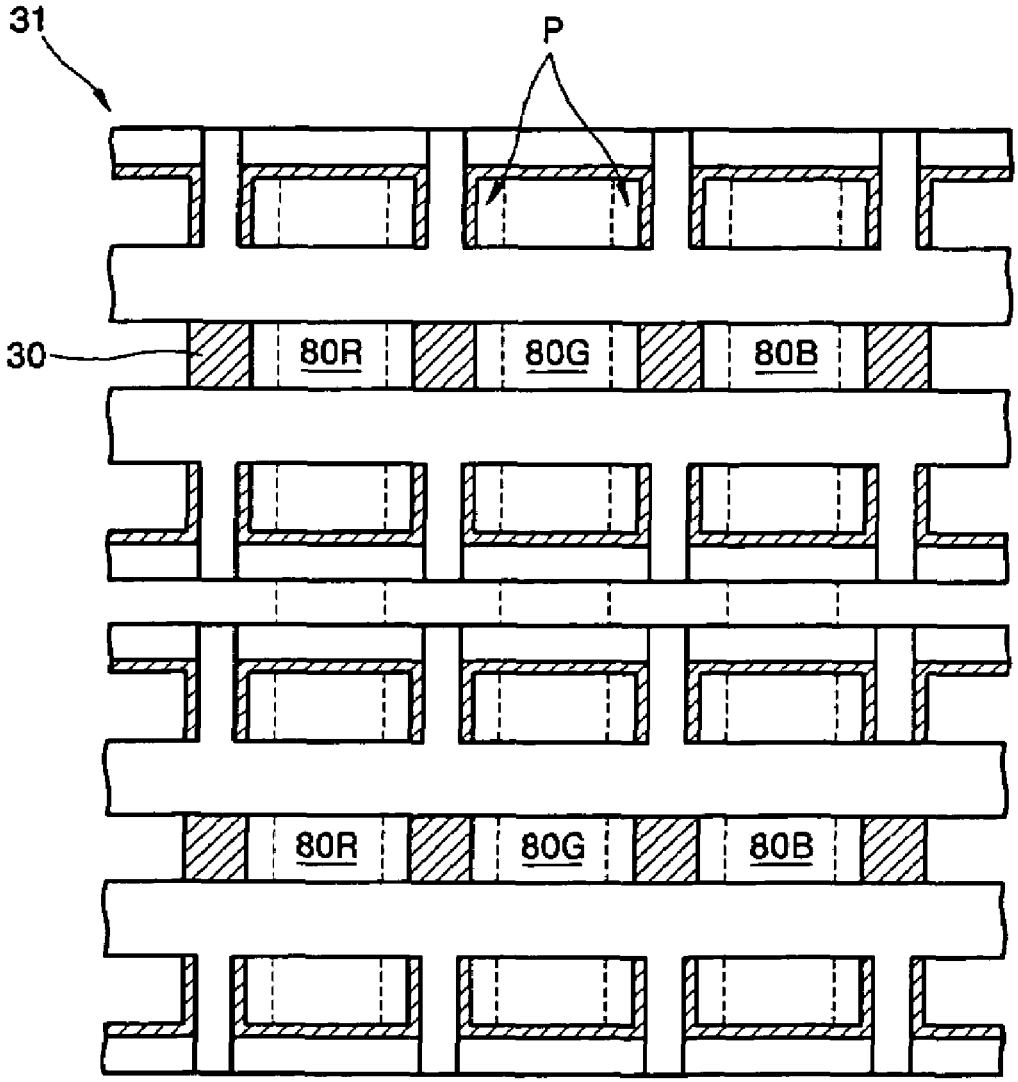
FIG. 1 (PRIOR ART)
FIG. 1 is a plan view of showing the disposition of discharge cells and sustain electrodes of a conventional PDP.
Figure 2:
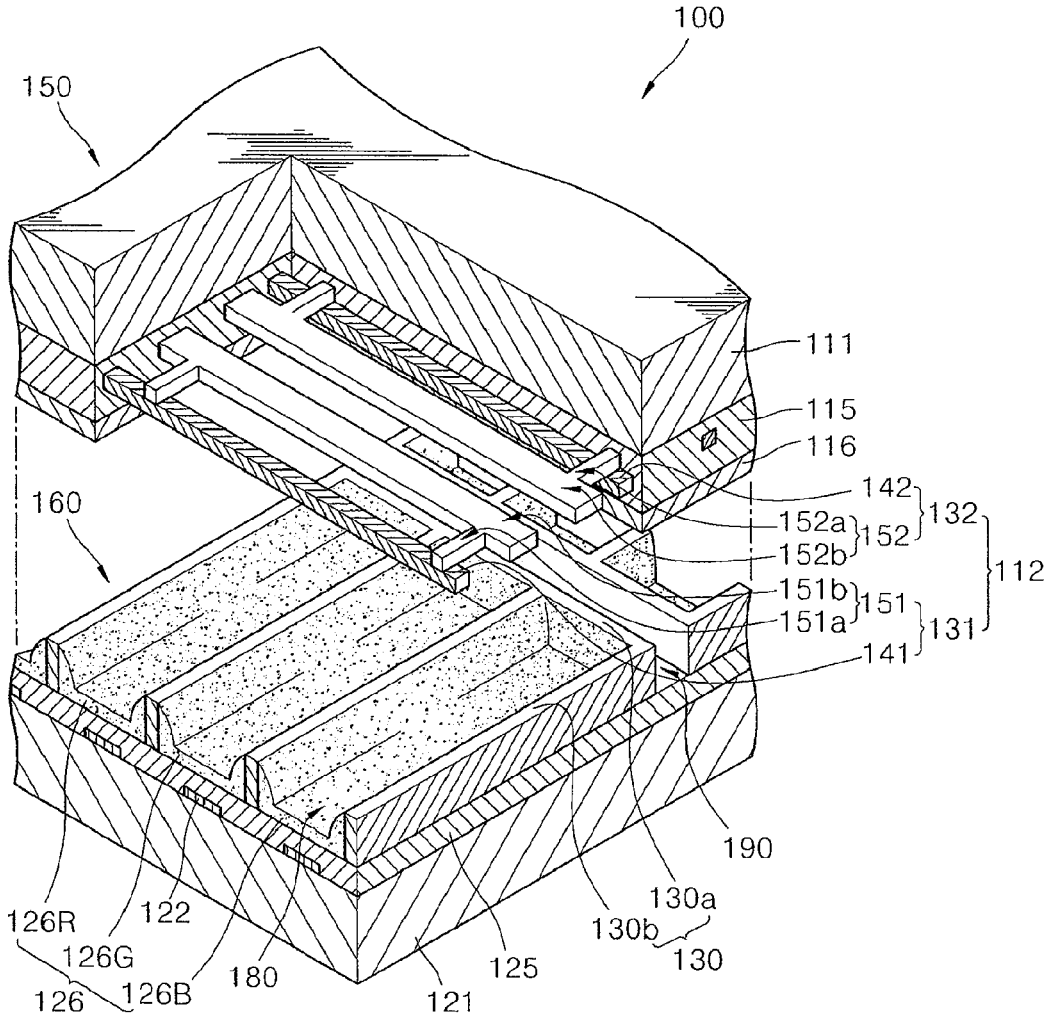
FIG. 2 is a cutaway exploded perspective view of a PDP according to an embodiment of the present invention.

FIG. 2 is a cutaway exploded perspective view of a PDP 100 according to an embodiment of the present invention.

Referring to FIG. 2, the PDP 100 comprises a rear substrate 121, a front substrate 111 disposed apart from the rear substrate 121, a plurality of barrier ribs 130 that define discharge cells 180 together with the front substrate 111 and the rear substrate 121 and disposed between the front substrate 111 and the rear substrate 121, a plurality of sustain electrode pairs 112 extended across the discharge cells 180, a plurality of address electrodes 122 extended across the discharge cells 180 to cross the in each discharge cell 180, a first dielectric layer 115 that covers the sustain electrode pairs 112, a second dielectric layer 125 that covers the address electrodes 122, fluorescent layers 126 disposed in the discharge cells 180, and a discharge gas filled in the discharge cells 180.

The sustain electrode pairs 112 are disposed on the front substrate 111. The front substrate 111 is formed from a transparent material in which glass is the typical substance.

The sustain electrode pairs 112 denote a pair of sustain electrodes 131 and 132 formed on a rear surface of the front substrate 111 for generating a sustain discharge, and the sustain electrode pairs 112 are arranged in parallel at a predetermined distance from each other on the front sub strate 111. Each sustain electrode pair 112 includes an X electrode 131 and a Y electrode 132.

The X and Y electrodes 131 and 132 respectively includes discharge electrodes 151 and 152 and bus electrodes 141 and 142. The discharge electrodes 151 and 152 can be formed of a conductive transparent material that can generate discharges and that does not interrupt the progress of light generated from a fluorescent layer 126 toward the front substrate 111. The transparent conductive material can be indium tin oxide (ITO), for example. However, transparent conductive material such as the ITO usually has great resistance. In addition, if the discharge electrodes 151 and 152 are formed using only transparent electrodes, the driving power must be increased due to a large voltage drop across the length of the transparent electrodes and response time is delayed. To solve this problem, bus electrodes 141 and 142 formed of a metal having a narrow width are disposed on the transparent electrodes.

The address electrodes 122 are arranged to cross the X electrode 131 and the Y electrode 132 on the rear substrate 121 facing a surface of the front substrate 111.

The address electrodes 122 are formed to generate an address discharge which facilitates a sustain discharge between the X electrode 131 and the Y electrode 132. More specifically, the address electrodes 122 reduce a discharge voltage prior to generate the sustain discharge. The address discharge occurs between the Y electrode 132 and the address electrode 122. When the address discharge is completed, positive ions are accumulated on the Y electrode 132 and electrons are accumulated on the X electrode 131, thereby facilitating the sustain discharge between the X electrode 131 and the Y electrode 132.

A space formed by a pair of the X and Y electrodes 131 and 132 and the address electrodes 122 crossing the X and Y electrodes 131 and 132 is a unit discharge cell 180 that forms a discharge unit.

A first dielectric layer 115 covering the sustain electrode pairs 112 is formed on the front substrate 111. The first dielectric layer 115 is formed of a dielectric, which can prevent a direct electrical communication between the X electrode 131 and the adjacent Y electrode 132 during sustain discharge, prevent the X electrode 131 and the Y electrode 132 from being damaged by the direct collision between positive ions or electrons and the sustain electrodes 131 and 132, and accumulate wall charge by inducing the charges. In one embodiment, the dielectric can be PbO, $B_2O_3$, or $SiO_2$, etc.

Also, a protection layer 116, conventionally formed of MgO, for example, is formed on the first dielectric layer 115. The protection layer 116 prevents the damaging of the first dielectric layer 115 from collisions with positive ions or electrons during discharging, has high light transmittance, and generates a lot of secondary electrons.

A second dielectric layer 125 covering the address electrodes 122 is formed on the rear substrate 121. The second dielectric layer 125 is formed of a dielectric that can prevent the damaging of the address electrodes 122 by colliding with positive ions or electrons during discharging and can induce wall charges. In one embodiment, the dielectric can be PbO, $B_2O_3$, or $SiO_2$, etc.

Figure 3:
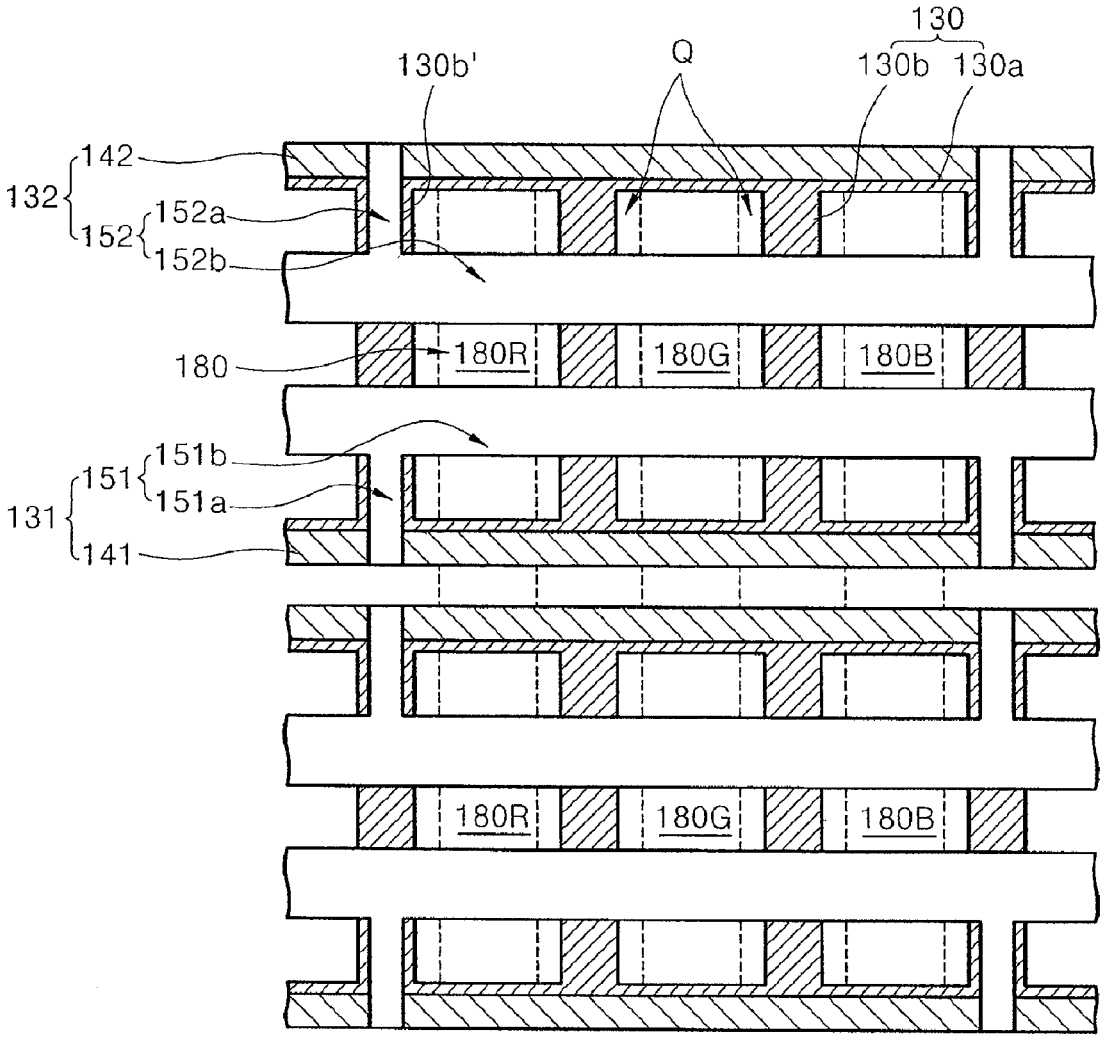
FIG. 3 is a plan view showing the disposition of discharge cells and sustain electrodes of FIG. 2.

Barrier ribs 130 that maintain a discharge distance, define discharge cells of red 180R, green 180G, and blue 180B light, and prevent electrical and optical cross talk between the adjacent discharge cells 180 are formed between the first dielectric layer 125 and the second dielectric layer 115. As depicted in FIGS. 2 and 3, the barrier ribs 130 include vertical units 130*b* formed in a direction in which the address electrodes 122 are extended and horizontal units 130*a* formed to cross the vertical units 130*b*. In the PDP 100 according to the present embodiment, a non-discharge region 190 is formed between the horizontal units 130*a* adjacent to each other in a direction in which the address electrodes 122 are extended since the horizontal units 130*a* are formed in a double barrier rib shape. The non-discharge region increases contrast of the PDP and also can be used as a passage for discharging an impure gas. However, the shape of the barrier ribs 130 is not limited thereto, but it can be an open type having a stripe shape.

The fluorescent layers 126 of red, green, and blue color are coated on side surfaces of the barrier ribs 130 and on the front surface of the first dielectric layer 115 on which the barrier ribs 130 are not formed.

The fluorescent layer 126 contains a substance that generates visible light by receiving ultraviolet rays. In one embodiment, the fluorescent layer 126 that generates red light includes a fluorescent material 126R such as Y(V,P)$O_4$:Eu, etc, the fluorescent layer 126 that generates green light includes a fluorescent material 126G such as $Zn_2SiO_4$:Mn, or $YBO_3$:Tb, etc, and the fluorescent layer 126 that generates blue light includes a fluorescent material 126B such as BAM:Eu, etc.

A discharge gas of Ne, He, Xe, or a gas mixture of these gases, for example, is used to fill in the discharge cells 180 which are then sealed.

In the PDP 100 according to the present embodiment of the present invention, the discharge electrodes 151 and 152 respectively include main body units 151*b* and 152*b* and connection units 151*a* and 152*a*. The main body units 151*b* and 152*b* are disposed toward the inside of the discharge cell 180 from the bus electrodes 141 and 142, and the connection units 151*a* and 152*a* connect the bus electrodes 141 and 142 and the main body units 151*b* and 152*b*. The main body units 151*b* and 152*b* are formed to extend across the discharge cell 180 to generate the discharge uniformly in the discharge cells 180. Also, the main body units 151*b* and 152*b* are formed parallel to the bus electrodes 141 and 142 and perpendicular with respect to the connection units 151 a and 152*a*.

As depicted in FIGS. 2 and 3, the bus electrodes 141 and 142 are disposed in front of the horizontal units 130*a* to improve the aperture ratio. Preferably, the bus electrodes 141 and 142 are disposed in a cast shadow region vertically to the front substrate of the horizontal units 130*a*.

In the PDP 100 according to the present embodiment, the connection units 151*a* and 152*a* are disposed only in front of vertical units 130*b*' formed between the red light discharge cell 180R and the blue light discharge cell 180B, but not disposed in front of the vertical units 130*b* that define the green light discharge cell 180G. To make uniform voltage applied to the main body units 151*b* and 152*b* connected to one of the bus electrode 141 and 142 and to obtain a structural stability of the PDP, the connection units 151*a* and 152*a* are preferably disposed in front of each of the vertical units 130*b*' of the barrier ribs 130 formed between the red light discharge cell 180R and the blue light discharge cell 180B.

As described above, the connection units 151*a* and 152*a* are disposed in shadow regions of the vertical units 130*b*' in a vertical direction to the front substrate 111. This is because, even though the connection units 151*a* and 152*a* are formed of a transparent material, the connection units 151*a* and 152*a* can not transmit 100% of the visible light resulting in the reduction of an aperture ratio of the PDP 100. Even though brightness can be slightly increased by increasing the generation of plasma during discharge, the increase in the discharge current eventually reduces the luminous efficiency of the PDP.

The connection units 151*a* and 152*a* and the main body units 151*b* and 152*b* can respectively be formed in one body for simplifying the manufacturing process.

The operation of the PDP 100 according to the present invention will now be described.

An address discharge is generated by applying an address voltage between the address electrodes 122 and the Y electrode 132. As a result of the address discharge, a discharge cell 180, in which a sustain discharge will generate, is selected.

Afterward, when a sustain discharge voltage is applied between the X electrode 131 and the Y electrode 132 of the selected discharge cell 180, a sustain discharge is generated by colliding the positive ions accumulated on the Y electrode 132 with the electrons accumulated on the X electrode 13. Ultraviolet rays are emitted from a discharge gas by reducing the energy level of the discharge gas which is excited by the sustain discharge. The emitted ultraviolet rays excite the fluorescent layer 126 coated in the discharge cell 180. Visible light is generated from the fluorescent layer 126 as the energy level of the fluorescent layer 126 is lowered, and an image is displayed by the emitted visible light.

As described above, the connection units 151*a* and 152*a* included in the discharge electrodes 131 and 132 are disposed on vertical units 130*b*' of the barrier ribs 130 formed between the red light discharge cell 180R and the blue light discharge cell 180B. That is, the connection units 151*a* and 152*a* are not disposed on the vertical units 130*b*' which have the green light discharge cell 180G therebetween. Therefore, the damage of fluorescent material 126G that generates green light by ion sputtering is reduced since space charges accumulated adjacent to the vertical barrier ribs that define the green light discharge cell 180G is reduced. In particular, the risk of ion sputtering that can be caused by a large potential energy difference in the plasma sheath region Q is reduced. Therefore, although a PDP is manufactured using a green light fluorescent material that includes ZnO, the damage to the green light fluorescent material caused by ion sputtering can be reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel device, comprising:

an array of a plurality of discharge cells, the plurality of discharge cells comprising a first group of discharge cells and a second group of discharge cells, wherein each of the first group of discharge cells comprises a ZnO based fluorescent material, and each of the second group of discharge cells is substantially free of the ZnO based fluorescent material, and wherein the discharge cells are partitioned by a plurality of barrier ribs comprising a first barrier rib extending in a first direction;

a plurality of discharge electrodes formed over the array, wherein the plurality of discharge electrodes comprises a first discharge electrode extending generally in the first direction, the first discharge electrode comprising a first material;

a plurality of bus electrodes formed over the array, wherein the plurality of bus electrodes comprises a first bus electrode extending generally in the first direction and substantially overlapping with the first barrier rib, the first bus electrode comprising a second material different from the first material;

wherein the first discharge electrode is electrically connected with the first bus electrode via at least one connector formed over the array; and wherein each connector does not overlap with discharge cells of the first group or barrier ribs abutting discharge cells of the first group.

2. The device of claim 1, wherein each connector is substantially perpendicular to the bus electrode and the discharge electrode, which are connected by the connector.

3. The device of claim 1, wherein each connector is formed over a boundary between two abutting discharge cells of the second group.

4. The device of claim 1, wherein the first group comprises green light emitting discharge cells.

5. The device of claim 1, wherein the ZnO based fluorescent material comprises $Zn_2SiO_4$:Mn.

6. The device of claim 1, wherein the discharge cells of the second group are substantially regularly distributed among the discharge cells of the first group in the array.

7. The device of claim 1, wherein the plurality of discharge electrodes is substantially transparent to visible light.

8. The device of claim 1, wherein the plurality of bus electrodes has an electric conductivity higher than the plurality of discharge electrodes.

9. A plasma display device, comprising:

a blue discharge cell comprising a blue light-emitting material;

a green discharge cell comprising a green light-emitting material;

a red discharge cell comprising a red light-emitting material;

a first wall partitioning the blue and green discharge cells;

a second wall partitioning the green and red discharge cells;

a third wall spaced from the second wall, the second and third walls interposing the red discharge cell therebetween;

a fourth wall spaced from the first wall, the first and fourth walls interposing the blue discharge cell therebetween;

a fifth wall crossing the first, second, third and fourth walls;

a first discharge electrode extending over the blue, green and red discharge cells, the first discharge electrode comprising a first material;

a first bus electrode extending substantially parallel to the first discharge electrode over the blue, green and red discharge cells, the first bus electrode comprising a second material different from the first material, wherein the first bus electrode is substantially overlapping with the fifth wall and extends along the fifth wall; and a first conductor electrically connecting the first discharge electrode to the first bus electrode, wherein the first conductor does not overlap with any of the green discharge cell, the first wall and the second wall.

10. The device of claim 9, wherein the first conductor extends over at least one portion selected from the group consisting of the blue discharge cell, red discharge cell, the third wall and the fourth wall.

11. The device of claim 9, wherein the first conductor extends over the third wall or fourth wall.

12. The device of claim 9, wherein the first conductor is substantially perpendicular to the first discharge electrode and the first bus electrode.

13. The device of claim 9, wherein the first conductor is integrally formed with the first discharge electrode.

14. The device of claim 9, wherein the green light-emitting material comprises a ZnO component.

15. The device of claim 9, wherein the green light-emitting material comprises $Zn_2SiO_4$:Mn.

16. The device of claim 9, further comprising:

a second discharge electrode extending over the blue, green and red discharge cells, the second discharge electrode comprising the first material;

a second bus electrode extending substantially parallel to the second discharge electrode over the blue, green and red discharge cells, the second bus electrode comprising the second material; and a second conductor electrically connecting the second discharge electrode to the second bus electrode, the second conductor extending only over a portion of the cells and walls excluding the green discharge cell and the first and second walls.

17. The device of claim 16, wherein the second discharge electrode is substantially parallel to the first discharge electrode.

18. The device of claim 16, wherein the second discharge electrode is substantially transparent to visible light while the second bus electrode is substantially non-transparent to visible light.

* * * * *